US005154908A

United States Patent [19]

Edie

[11] Patent Number: 5,154,908

[45] Date of Patent: Oct. 13, 1992

[54] CARBON FIBERS AND METHOD FOR PRODUCING SAME

[75] Inventor: Danny D. Edie, Clemson, S.C.

[73] Assignee: Clemson University, Clemson, S.C.

[21] Appl. No.: 775,131

[22] Filed: Sep. 12, 1985

[51] Int. Cl.[5] ..... C01B 31/02

[52] U.S. Cl. ..... 423/447.1; 423/447.2; 423/447.4; 423/447.6; 264/29.2

[58] Field of Search ..... 423/447.1, 447.2, 447.4, 423/447.6; 425/725; 428/367; 264/29.2, 176 F, 177 F

[56] References Cited

U.S. PATENT DOCUMENTS

| | | | |
|---|---|---|---|
| 3,419,936 | 1/1969 | Sims | 264/177 F |
| 3,439,381 | 4/1969 | Plomp | 264/177 F |
| 3,478,389 | 11/1969 | Bradley et al. | 425/72 S |
| 4,208,267 | 6/1980 | Diefendorf et al. | 423/447.1 |
| 4,301,135 | 11/1981 | Nazem et al. | 264/29.2 |
| 4,511,625 | 4/1985 | Nazem et al. | 264/29.2 |

FOREIGN PATENT DOCUMENTS

| | | | |
|---|---|---|---|
| 58-209857 | 11/1983 | Japan | 423/447.2 |
| 59-168126 | 9/1984 | Japan . | |

OTHER PUBLICATIONS

Fox, Melt Spinning of Non-Circular Carbon/Graphite Fibers from Mesophase Pitch, Clemson University, May 1984.

Singer, "The Mesophase and High Modulus Carbon Fibers from Pitch," Carbon, vol. 16, pp. 409–415 (1978).

Berg, et al., "Friction and Wear of Graphite Fiber Composites," NBS Journal of Research, vol. 76C, Nos. 1 and 2, Jun., 1972.

Singer, Leonard S., "Carbon Fibers from Mesophase Pitch," Fuel, vol. 60, Sep., 1981, pp. 839–847.

*Primary Examiner*—Robert Kunemund

*Attorney, Agent, or Firm*—Dority & Manning

[57] ABSTRACT

Carbon fibers having a multi-lobal transverse cross-section are produced by extruding a carbonaceous anisotropic liquid precursor through a spinneret having a capillary with a multi-lobal cross-section, solidifying the extruded filament, rendering the filament infusible, and heating the filament in an inert environment at a temperature sufficient to substantially increase the tensile strength and modulus of elasticity of the filament.

24 Claims, 10 Drawing Sheets

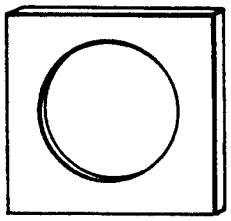
Fig. 5a
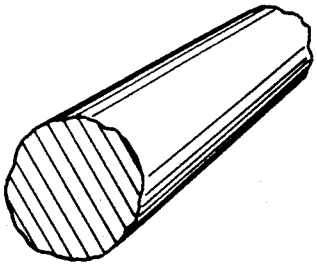
(PRIOR ART)
Fig. 5b
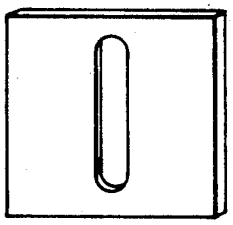
Fig. 6a
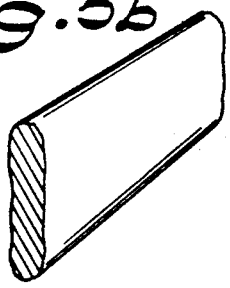
Fig. 6b
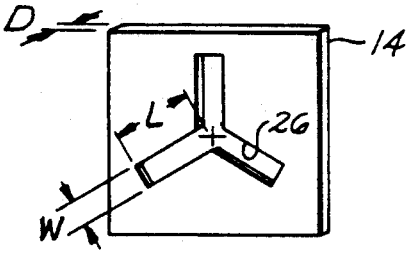
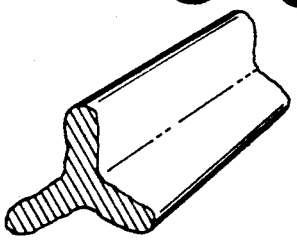
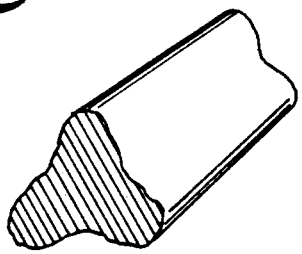
Fig. 7a Fig. 7b Fig. 7c
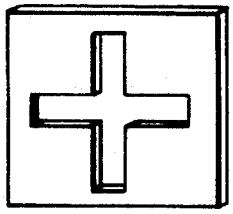
Fig. 8a
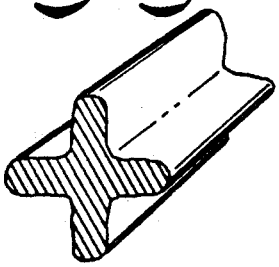
Fig. 8b

CARBON FIBERS AND METHOD FOR PRODUCING SAME

BACKGROUND OF THE INVENTION

The invention relates to carbon fibers and to a method for producing same.

There are many commercial uses for fibers which are high in strength and light in weight. Carbon/graphite (C/G) fibers exhibit such high strength and light weight mechanical properties.

The mechanical properties of C/G fibers depend upon how well their structure resembles the anisotropic structure of an ideal, i.e., perfect, graphite crystal. The three dimensional lattice structure of an ideal graphite crystal is basically a network of hexagonal crystal planes stacked one on top of the other with an orientation such that within each layer, covalent carbon-carbon bonds link individual graphite crystals together in the plane. These strong bonds give graphite its high strength characteristics in the direction parallel to these planes. Each layer of hexagonal crystal planes is perfectly parallel to its adjacent planes. Because these planes are perfectly parallel to one another, the interlayer spacing is very small, and consequently the ideal graphite crystal has a very high density. The closeness of three parallel planes gives graphite a high stiffness characteristic. A perfect crystal has a theoretical tensile modulus of elasticity of 146 million pounds per square inch (msi), and a theoretical ultimate tensile strength of 15 msi.

Commercially produced C/G fibers differ from the perfect crystals of an ideal graphite lattice structure due to both surface and internal flaws and in the lesser amount of preferred orientation along the fiber axis, which is in the direction parallel to the hexagonal crystal planes. Structural flaws affect the ultimate tensile strength, and the degree of preferred orientation along the fiber axis affects the tensile modulus of elasticity.

Carbon/graphite fibers have been produced from a number of different precursor materials. One such material is polyacrylonitrile (PAN), which is described as an atactic linear polymer whose fibril 3-D network tends to form an irregular helix structure as shown in FIG. 1.

A typical process for producing PAN-based C/G fibers is shown schematically in FIG. 1. Typically, the as-spun fiber is obtained by wet spinning PAN or its copolymers into a coagulation bath. The purpose of using a copolymerized precursor is to lower the glass transition temperature, thereby allowing the as-spun fiber to be stretched in liquids which boil at lower temperatures. The as-spun helical fiber is stretched to better orient the polymer molecules along the fiber axis. It is thought that oxidation of the stretched fiber maintains the preferred orientation along the fiber axis by cyclization of the nitrile groups as shown in FIG. 1. Suggested temperatures for oxidation are 220°-270° C. for up to seven hours. Most of the non-carbon elements are driven off in gaseous form during the carbonization step, which occurs in an inert atmosphere between 1000° and 1500° C. Stretching the fiber during carbonization also improves the strength and stiffness of PAN-based carbon fibers. A further heat treatment step can be performed at temperatures between 1800° and 2500° C. for less than one hour to purify and provide a higher degree of preferred orientation of the 3-D turbostratic structure.

The modulus of elasticity of PAN-based C/G fiber increases with heat treatment temperature, but the tensile strength reaches a maximum value of approximately 450 ksi at a temperature of approximately 1600° C. Surface flaws in the as-spun PAN-based fiber may be retained throughout the entire process and limit fiber strength. Internal flaws caused by voids left by rapidly evolving gasses may occur during heat treatment and cause a decrease in tensile strength with higher temperatures. Moreover, the stretching required to obtain the desired strength characteristics is time-consuming and expensive in commercial production.

Since PAN will thermally decompose prior to melting, a solution of PAN in a solvent such as dimethyl formamide is normally spun into a filament using either a "wet" solution spinning technique, as described above, or a "dry" solution spinning technique. In both wet and dry spinning, the solvent must diffuse through the filament and then evaporate into the spinning chamber (dry spinning) or enter the coagulating bath solution (wet spinning). If the rate of evaporation of the solvent (or the rate of loss of solvent into the coagulating bath) is less than the rate of diffusion of the solvent through the PAN filament, the filament will dry uniformly and the filament will have a circular cross-section. However, if the rate of loss of solvent at the filament surface is greater than the rate of diffusion of solvent through the filament, then the surface of the filament will harden faster than the core, and a collapsed, dogbone-shaped fiber will result. Thus, it is this balance between mass transfer away from the fiber and diffusion within the fiber which normally governs the fiber cross-sectional shape in PAN spinning processes. The precipitation process required to produce a PAN fiber limits the possible non-circular cross-sections which can be produced and stably controlled in a commercial process.

A PAN-based carbon fiber having a dogbone-shaped cross-section is observed to be lower in strength than PAN-based fibers of circular cross-section. PAN-based fibers having a trilobal cross-section also is observed to be weaker than PAN-based fibers of circular cross-section. The strength of PAN-based fiber of circular cross-section decreases with higher carbonizing temperature. However, there is some evidence in the literature that dogbone-shaped PAN-based fiber becomes higher in strength with higher carbonizing temperature.

Pitch, whether natural in origin, such as coaltar or petroleum pitch, or synthetic in origin, such as specially prepared polyvinylchloride (PVC), has been used as a precursor for producing a melt spun C/G fiber. Pitch, a graphitizable substance, is a collection of hydrocarbons ranging from low molecular weight paraffins to high molecular weight large aromatics. A graphitizable substance has been defined as one which fuses or becomes plastically deformed during heat treatment. According to this definition, rayonbased and PAN-based C/G fibers are not graphitizable. While they may set up in a turbostratic configuration, rayon and PAN are incapable of forming the characteristic three dimensional structure of graphite.

As discussed in this patent application, graphite fibers are considered to be those fibers which have been heat-treated above 1700° C. and have a carbon content of at least 99 percent. Carbon fibers are those fibers which have been heat-treated below 1700° C. and have a carbon content of between 80 and 95 percent.

It has been reported that upon heating graphitizable substances such as pitch materials, the original material melts or fuses to form an isotropic pitch-like mass. As heating continues, spherical bodies begin to form. The spherical bodies are of an anisotropic liquid crystalline nature as viewed under polarized light. These spheres continue to grow and coalesce until a dense continuous anisotropic phase forms, which phase has been termed the "mesophase." Thus, the mesophase is the intermediate phase or liquid crystalline region between the isotropic pitch and the semi-coke obtainable at higher temperatures.

U.S. Pat. No. 4,208,267 discloses a method for producing mesophase pitch-based C/G fibers in which a nearly 100 percent mesophase pitch precursor is melt spun. This method is illustrated schematically in FIG. 2. The nearly 100 percent mesophase precursor is prepared by converting a solvent-insoluble fraction of isotropic pitch into an anisotropic pitch containing between 75 and 100 percent mesophase by heating to between 230° to 400° C. for less than ten minutes. For the most part, it is the large aromatics which convert to the mesophase upon heating. The solvent-insoluble fraction is pelletized as a solid and then melt spun through a conventional screw extruder at spin temperatures of between 360° and 370° C. to produce a fiber filament of circular cross-section. Typical viscosities for the mesophase precursor at such spinning temperatures range between 200 and 700 poise.

If the as-spun circular fibers produced from the mesophase were immediately subjected to carbonizing temperatures, the fibers would degrade and lose their anisotropic molecular orientation. To avoid loss of orientation, the as-spun fibers are thermoset at 200° to 350° C. in an oxygen atmosphere. After this oxidation step, carbonization/graphitization is accomplished in a horizontal graphite resistance furnace at temperatures between 1000° and 2000° C. under a nitrogen atmosphere.

It has been thought that the orientation which is imparted to the mesophase during spinning gives rise to the graphitic orientation developed in the fiber during the carbonizing steps. As the molecularly random mesophase precursor flows through the spinneret capillary, a certain amount of order is produced such that the liquid crystals preferentially orient themselves along the longitudinal axis of the fiber. Accordingly, the costly process of high tension heat treatment is not needed by mesophase pitch-based C/G fibers to induce preferred alignment.

Commercial producers of synthetic fibers have produced non-circular synthetic fibers from melt spun polymers, such as polyester, nylon and polypropylene, for about 20 years. The extrusion process is identical to the one used to produce circular synthetic fibers, except that spinnerets with non-circular capillaries are used rather than ones with circular capillaries.

Polymers have a relatively large range of temperatures over which the viscosity of the polymer is suitable for producing a melt spun fiber, whether circular or non-circular in cross-section. A polymer such as polystyrene shrinks during the draw-down process of melt spinning under typical commercial conditions, from a diameter of about 700 microns to a final diameter of about 40 microns over a distance of about 40 millimeters. This distance is sometimes referred to as the quench distance and is a critical parameter in obtaining a non-circular polymer fiber.

For many materials, surface tension is the single most important obstacle to overcome in melt spinning non-circular fibers. For example, the high surface tension of glass has prevented commercial production of non-circular glass fibers. Polymers, on the other hand, more readily lend themselves to being spun into a non-circular fiber because polymers have a relatively low surface tension.

Several factors reduce the likelihood that non-circular carbon fibers can be produced by melt spinning an anisotropic precursor such as mesophase pitch. First, anisotropic precursors have a surface tension between that of glass and that of polymers. In addition, the quench distance for a circular carbon fiber produced from an anisotropic precursor is approximately 4 mm over which a 200 micron diameter is drawn down to a twelve micron diameter. Third, the viscosity of an anisotropic precursor is far more temperature dependent than the viscosity of polymers.

OBJECTS AND SUMMARY OF THE INVENTION

It is a principal object of the present invention to provide a carbon fiber of improved tensile strength and modulus of elasticity over presently available carbon fibers.

It also is a principal object of the present invention to provide a method of producing carbon fibers having improved tensile strength characteristics and an improved modulus of elasticity over presently available carbon fibers.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, a method for producing a high elastic modulus, high tensile strength carbon fiber comprises: providing a molten precursor containing a substantial proportion of carbonaceous anisotropic material; extruding the molten precursor through a spinneret defining a capillary having at least one lobe-shaped cross-sectional area; solidifying the extruded precursor as it emerges from the spinneret, into a fiber filament having a transverse cross-section substantially like the transverse cross-section of the capillary; rendering the fiber filament infusible; and thereafter heating the fiber filament in an inert environment at a temperature sufficient to substantially increase the tensile strength and the modulus of elasticity of the fiber filament.

The objects and the purpose of the present invention also are accomplished by a carbon fiber having at least one lobe, each lobe in a transverse cross-section of the fiber having a microstructure emanating outwardly from a line extending along the length of the lobe.

The accompanying drawings, which are incorporated in and constitute a part of this specification, illustrate the embodiments of the invention and, together with the description, serve to explain the principles of the invention.

BRIEF DESCRIPTION OF THE DRAWINGS OF THE PREFERRED EMBODIMENTS

Figure 9A:
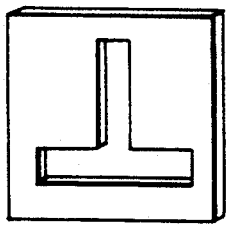
Figure 9B:
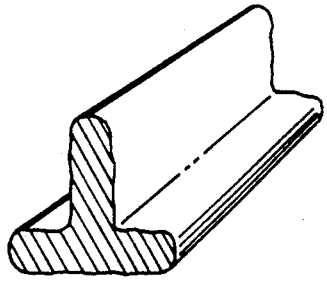
Figure 10A:
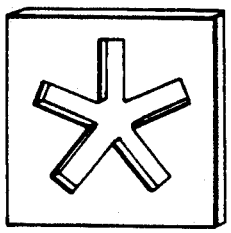
Figure 10B:
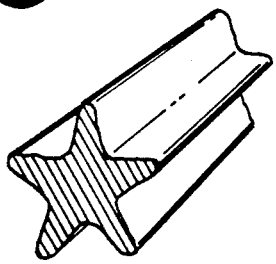
Figure 11A:
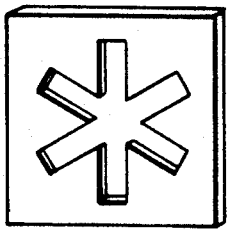
Figure 11B:
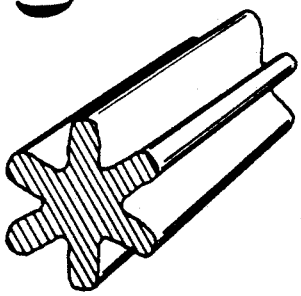
Figure 12A:
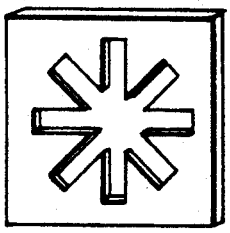
Figure 13:
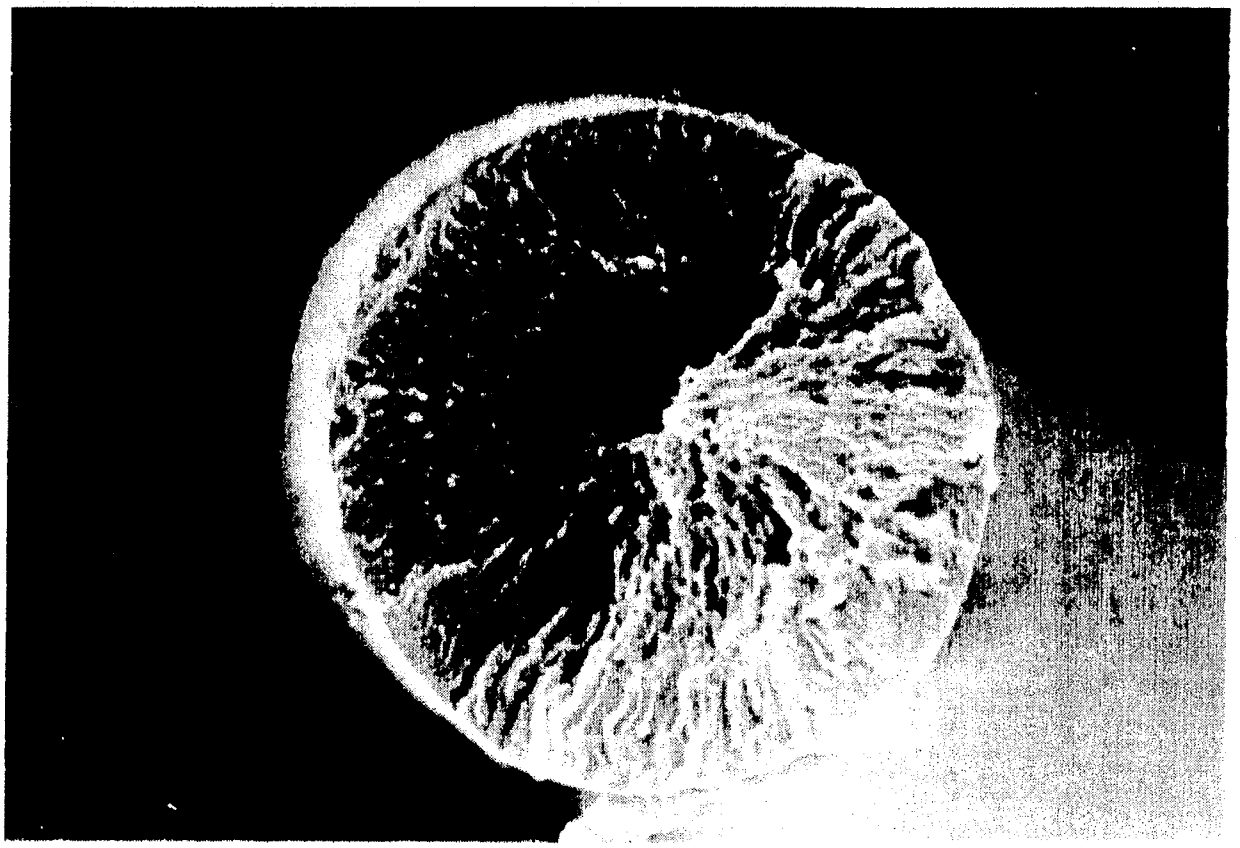
Fig. 13 (PRIOR ART)
Figure 14:
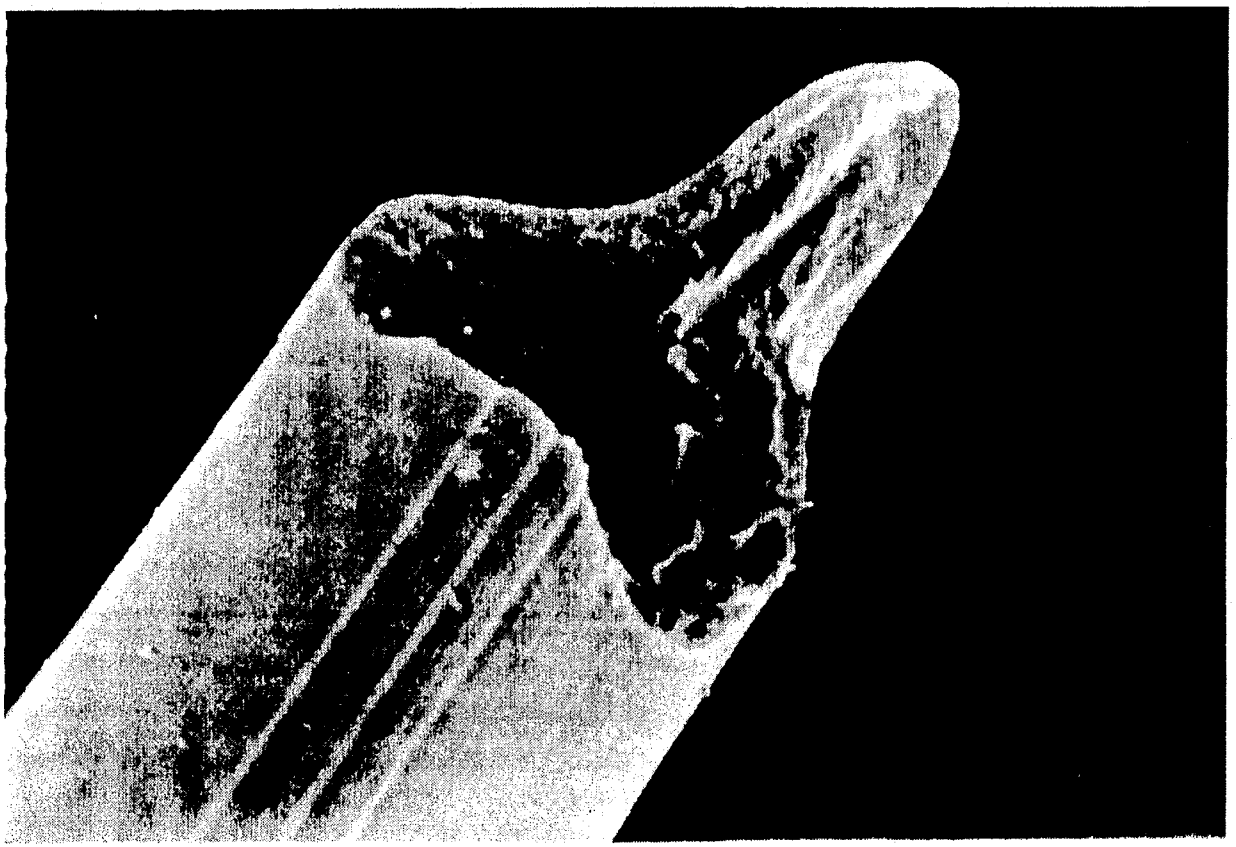
Figure 15:
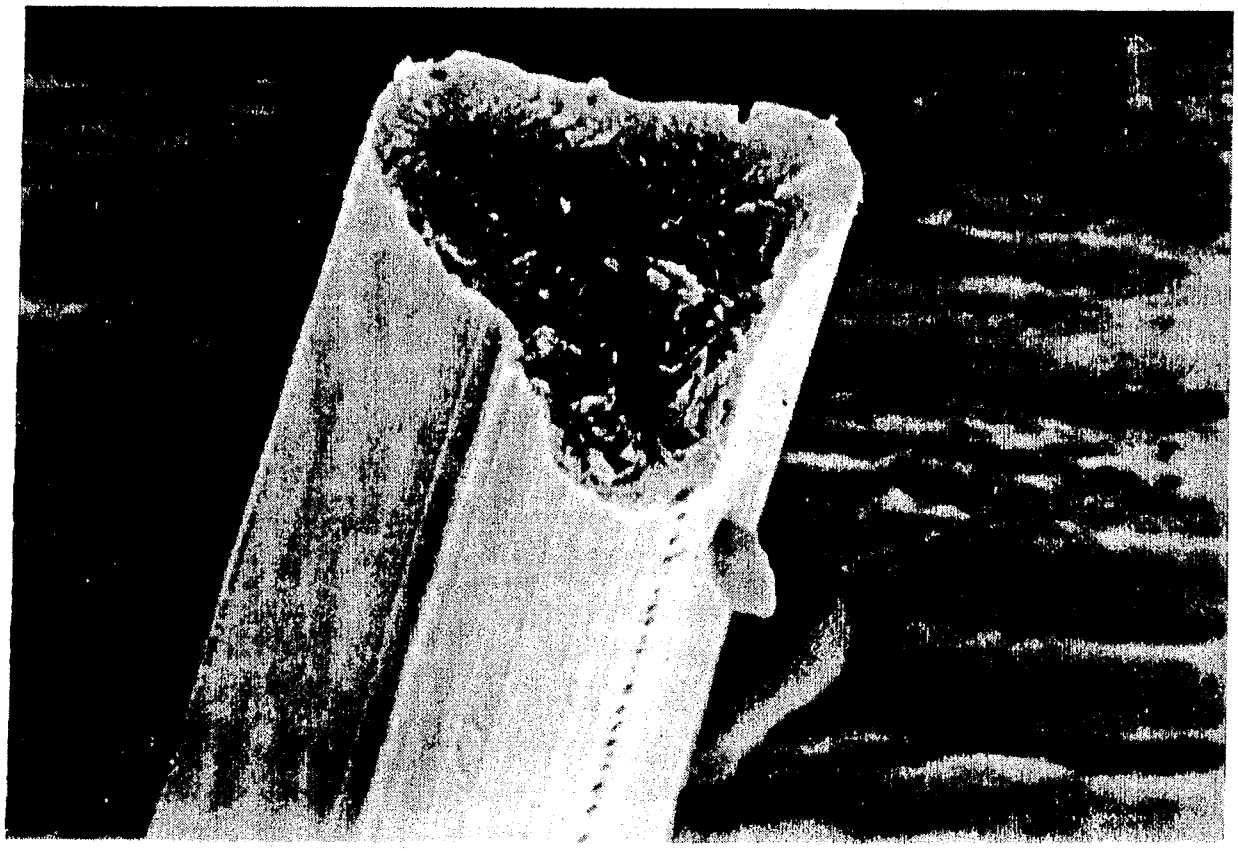
Figure 16:
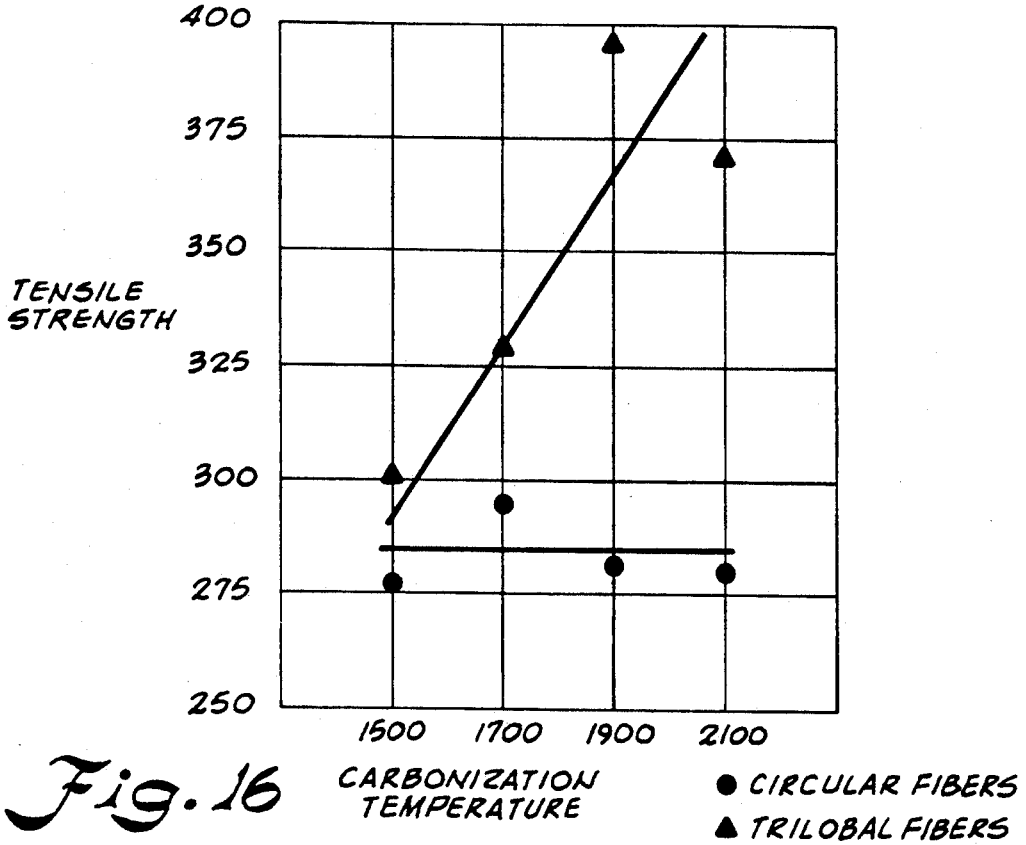
Figure 17:
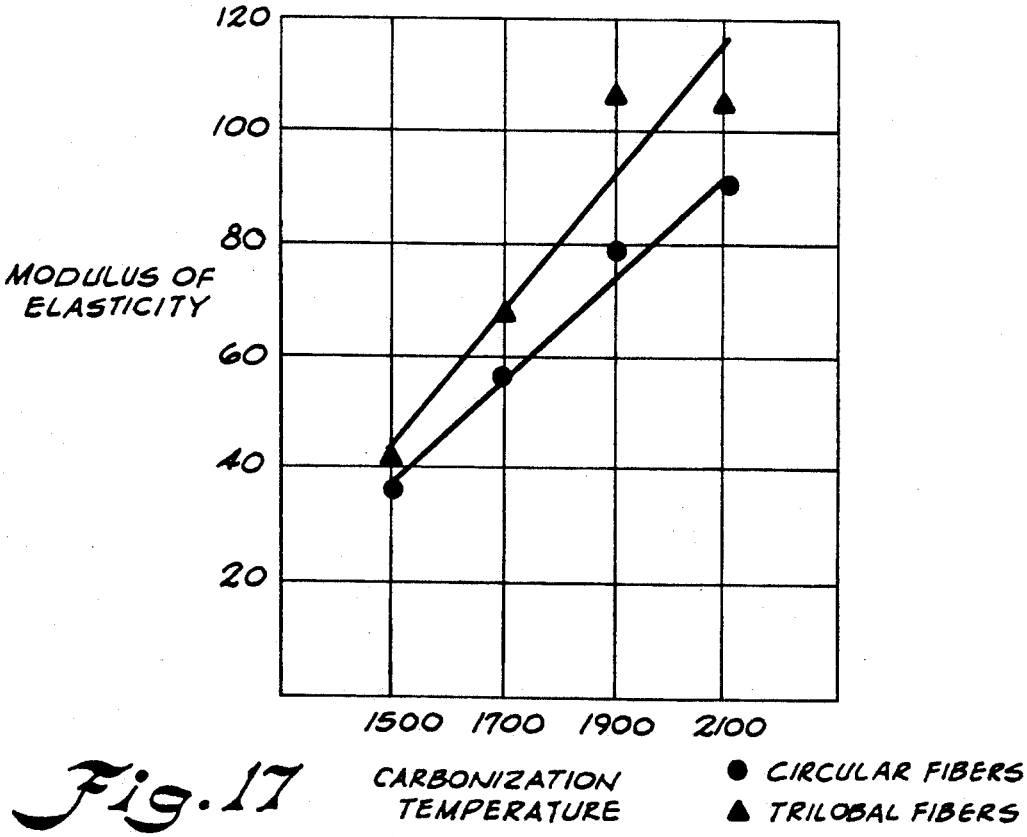
Figure 18:
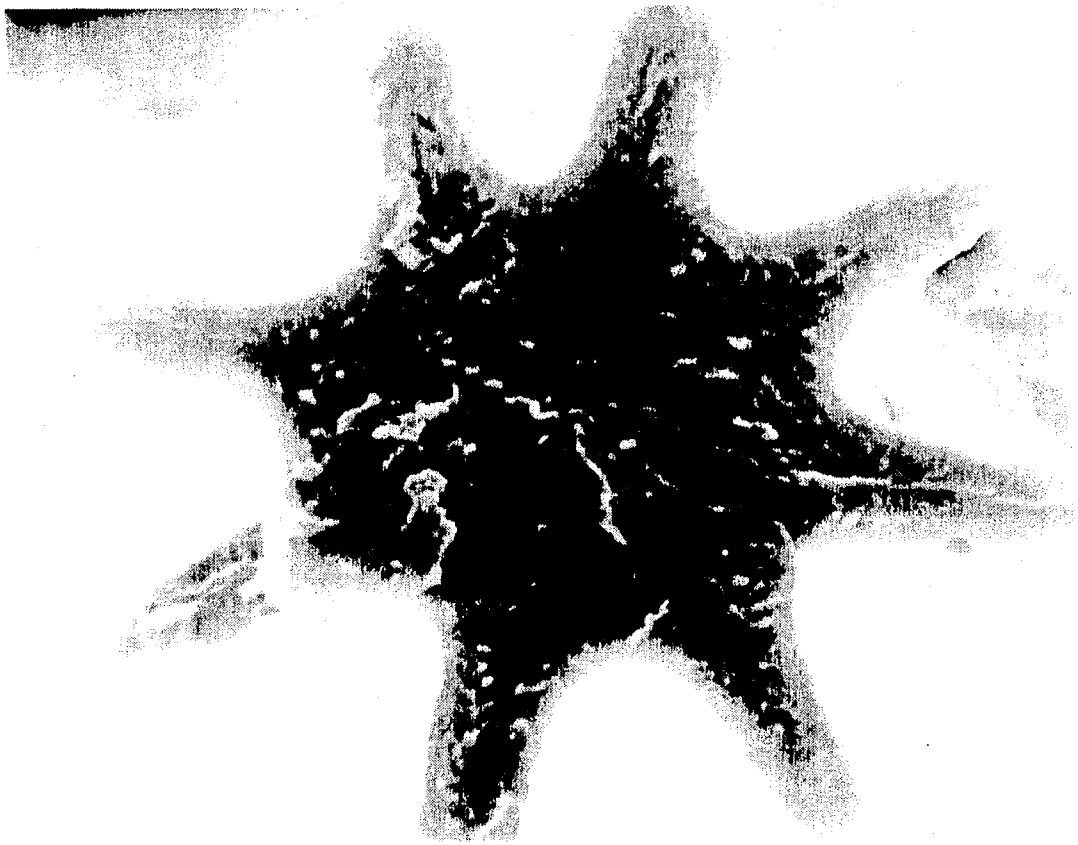

FIG. 5*a* is a perspective view of an embodiment of a spinneret capillary used in a conventional method for producing C/G fiber and FIG. 5*b* is an associated conventional melt spun carbon fiber filament of circular transverse cross-section shown in perspective;

FIG. 6*a* is a perspective view of an embodiment of a spinneret capillary used in an embodiment of the method of the present invention and FIG. 6*b* is the associated fiber filament of the present invention;

FIG. 7*a* is a perspective view of an embodiment of a spinneret capillary used in an embodiment of the method of the present invention and FIG. 7*b* and 7*c* are the associated fiber filaments of the present invention;

FIG. 8*a* is a perspective view of an embodiment of a spinneret capillary used in an embodiment of the method of the present invention and FIG. 8*b* is the associated fiber filament of the present invention;

FIG. 9*a* is a perspective view of an embodiment of a spinneret capillary used in an embodiment of the method of the present invention and FIG. 9*b* is the associated fiber filament of the present invention;

FIG. 10*a* is a perspective view of an embodiment of a spinneret capillary used in an embodiment of the method of the present invention and FIG. 10*b* is the associated fiber filament of the present invention;

FIG. 11*a* is a perspective view of an embodiment of a spinneret capillary used in an embodiment of the method of the present invention and FIG. 11*b* is the associated fiber filament of the present invention;

FIG. 12*a* is a perspective view of an embodiment of a spinneret capillary used in an embodiment of the method of the present invention and FIG. 8*b* is the associated fiber filament of the present invention;

FIG. 13 is a photomicrograph of a plan view of an embodiment of a conventional carbon fiber of circular cross-section;

FIG. 14 is a photomicrograph of a perspective view of an embodiment of a carbon fiber according to the present invention;

FIG. 15 is a photomicrograph of a perspective view of an embodiment of a carbon fiber according to the present invention;

FIG. 16 is a graphical comparison of the tensile strength of conventional circular cross-section carbon fibers and trilobal cross-sectional carbon fibers of the present invention as a function of carbonization temperature;

FIG. 17 is a comparison of the modulus of elasticity of conventional circular cross-section carbon fibers and trilobal cross-section carbon fibers of the present invention as a function of carbonization temperature; and FIG. 18 is a photomicrograph of a plan view of an embodiment of a carbon fiber according to the present invention.

DESCRIPTION OF THE PREFERRED EMBODIMENTS

Reference now will be made in detail to the present preferred embodiments of the invention, examples of which are illustrated in the accompanying drawings.

In accordance with the present invention, a method for producing a high elastic modulus, high tensile strength carbon fiber, comprises: providing a molten precursor containing a substantial proportion of carbonaceous anisotropic material; extruding the molten precursor through a spinneret defining a capillary having at least one lobe-shaped cross-sectional area; solidifying the extruded precursor as it emerges from the spinneret, into a fiber filament having a transverse cross-section substantially like the transverse cross-section of the capillary; rendering the fiber filament infusible; and thereafter heating the fiber filament in an inert environment at a temperature sufficient to substantially increase the tensile strength and modulus of elasticity of the fiber filament.

Figure 4:
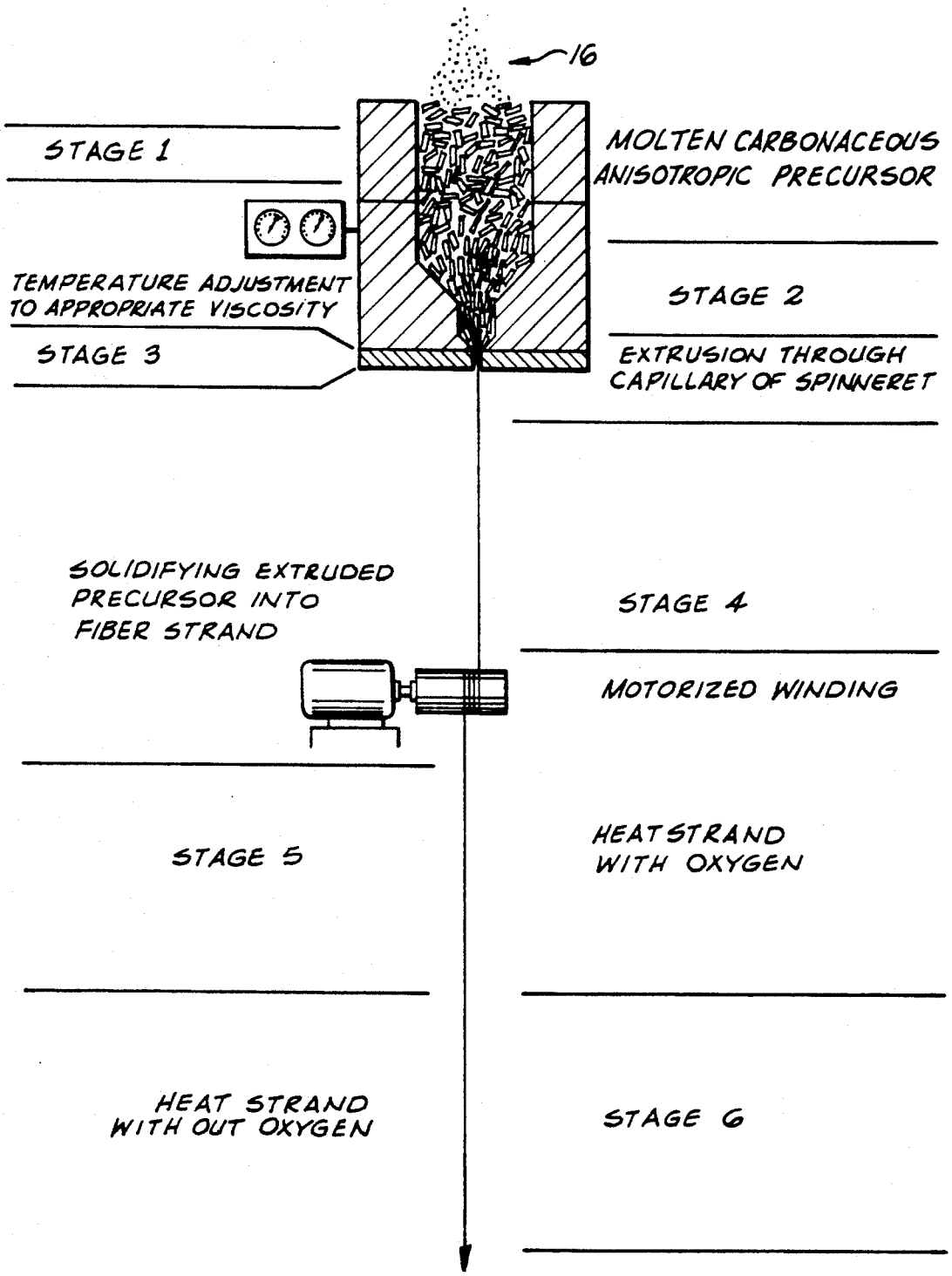
FIG. 4 is a block diagram of an embodiment of the method of the present invention.

Referring to FIG. 4 for example, a preferred embodiment of the method for producing a high elastic modulus, high tensile strength carbon fiber according to the present invention comprises providing a molten precursor containing a substantial proportion of carbonaceous anisotropic material. A suitable precursor material can be obtained according to the preparations disclosed in U.S. Pat. No. 4,208,267 to Diefendorf et al, entitled, "Forming Optically Anisotropic Pitches," which is hereby incorporated herein by reference. Additional examples of suitable precursor materials are disclosed in each of U.S. Pat. Nos. 4,017,327 and 4,026,788, which are hereby incorporated herein by reference. Other pitch materials suitable for providing precursor material to be used in the method of the present invention include petroleum asphalt, coal tar pitch, and polyvinylchloride.

The average bulk density of the mesophase pitch precursor pellets used in producing the conventional circular carbon fibers and the multilobal carbon fibers of the present invention was 0.48 g/cc, and the melt density was 1.29 g/cc. The ash content was found to be 0.0045 percent. The glass transition temperature was 244° C., while the melting temperature was about 280° C. The melt viscosity ranges from 1100 to 550 poise at the extremes of the spin window of 352° and 358° C., respectively. At the spin temperature of 355° C., the melt viscosity was 780 poise.

Figure 12B:
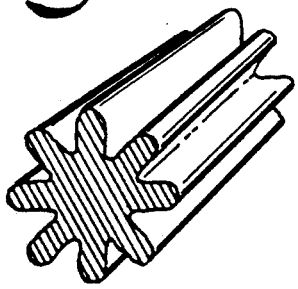

In further accordance with the invention, the method for producing a high elastic modulus, high tensile strength carbon fiber, comprises extruding the molten precursor through a spinneret defining a capillary having at least one lobe-shaped cross-sectional area. The molten precursor is extruded into an ambient atmosphere. An embodiment of the process apparatus for practicing an embodiment of the method of the present invention disclosed in FIG. 3 differs from a conventional melt spinning apparatus primarily in the shape of the cross-sectional area of the capillary of the spinneret through which the precursor is extruded to form a fiber filament. As shown in FIGS. 6–12, the spinneret capillaries used in the process apparatus for practicing an embodiment of the method of the present invention have in common at least one lobe-shaped cross-sectional area. The lobe is characterized by having a linear symmetry rather than a circular symmetry. For example, FIG. 6 illustrates an two-lobed spinneret and FIG. 12 illustrates an eight-lobed spinneret. As shown for example in FIG. 7, each lobe has a characteristic length L measured from the center point to the end of the lobe. A width W and a depth D for each spinneret capillary are also measured as shown in FIG. 7*a*.

The spin window is defined as the melt temperature range over which fiber could be spun and adequately taken up on a winder. The lower end of the spin window is governed by the melt viscosity. At the lower end, the fluid is insufficiently melted and too viscous to be able to expel gas at the fiber surface and then "reheal" during extrusion, resulting in a porous brittle fiber that breaks on wind-up. At the upper end of the spin window, the viscosity of the pitch is too low, and the material drips through the spinneret instead of extruding as continuous filaments. The spin window was determined to be 352° through 358° C. inclusive. At temperatures of 351° C. and below, the fibers were too brittle, and no fiber sample could be collected. At temperatures of 360° C. and above, the material was too hot, and no fibers could be collected.

Figure 1:
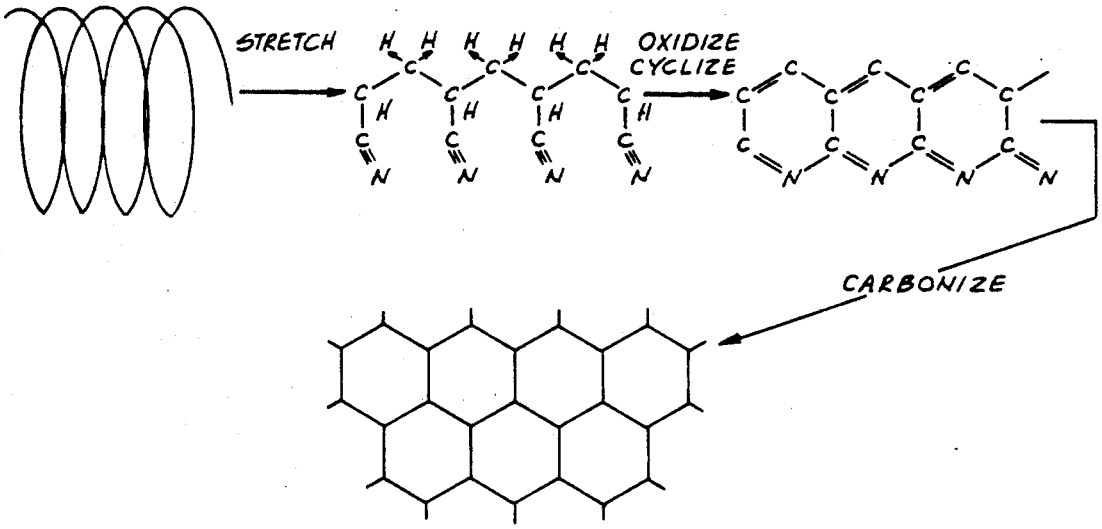
Fig. 1 (PRIOR ART)
FIG. 1 is a schematic diagram of a conventional PAN-based process for producing a circular cross-section C/G fiber.
Figure 2:
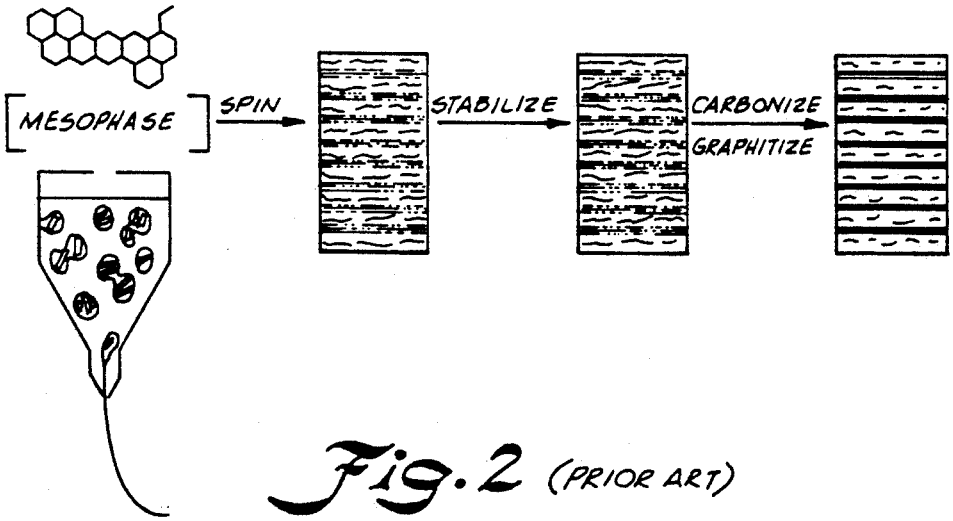
Fig. 2 (PRIOR ART)
FIG. 2 is a schematic diagram of a conventional mesophase pitch-based process for producing a circular cross-section C/G fiber.
Figure 3:
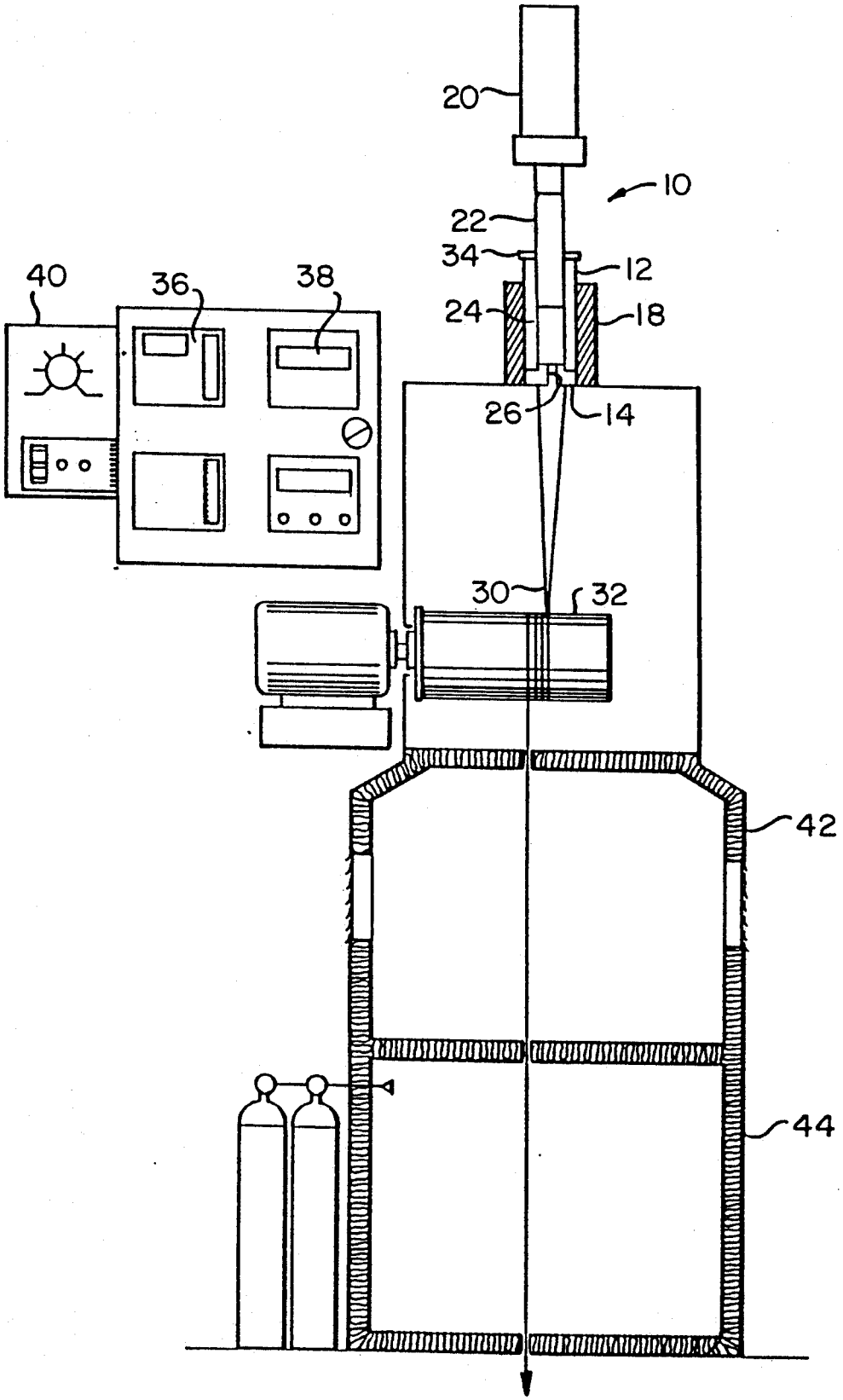
FIG. 3 is a schematic diagram of an embodiment of the process apparatus for practicing an embodiment of the method of the present invention.

As shown in FIG. 5, conventional carbon fiber filaments exhibit a circular cross-sectional area profile of the conventional circular spinnerets used in extruding same. The lobe-shaped cross-sectional areas of the capillaries of the spinnerets used in the embodiment of the apparatus shown in FIG. 3 are examples of spinnerets used in a conventional plastic extrusion process.

In further accordance with the invention, the method for producing a high elastic modulus, high tensile strength carbon fiber, comprises solidifying the extruded precursor as it emerges from the spinneret, into a fiber filament having a transverse cross-section substantially like the transverse cross-section of the capillary of the spinneret. In the embodiment of the invention shown in FIGS. 3 and 4, solidification of the filament usually occurs within about one inch from the exit of the spinneret capillary. The exact degree to which the non-circular fiber replicates the transverse cross-sectional shape of the spinneret capillary depends on the viscosity and surface tension of the precursor being extruded, the amount of draw-down the fiber undergoes upon extrusion, the rate that the fiber is quenched or cooled as it is drawn by a collection device, and the amount of die-swell exhibited by the precursor upon extrusion. In the embodiment of the method of the present invention, the temperature of the precursor is monitored so that it may be maintained at a temperature appropriate to ensure that the viscosity of the precursor falls within a range between about 250 poise and about 2000 poise as the precursor is extruded through the spinneret. The spin temperature of the precursor is adjusted until the fiber filament emerging from the spinneret maintains a cross-section substantially like the cross-section of the capillary of the spinneret.

Process variables which can be adjusted to overcome the effects of surface tension, which forces a non-circular cross-section filament to revert to a circular cross-section, are the shape of the spinneret capillary, the spinning temperature (precursor viscosity during extrusion), the cooling rate, and the draw-down rate. Regarding the shape of the capillary, non-circular shape retension improves in direct proportion to the length of each lobe in the capillary cross-section and inversely in proportion to the width of each lobe of the capillary cross-sectional area. The more viscous the precursor, the more resistant is the fiber to the effects of surface tension, and thus the better the fiber will retain its non-circular shape. Lowering the spin temperature increases the melt viscosity. However, the precursor will not flow through the spinneret capillaries if the spin temperature is too low. The rapid cooling rate increases the viscosity of the extruded filament and thereby minimizes the deviation of the shape of the filament from the shape of the capillary cross-section. Increasing the take-up speed stretches the fiber and decreases the cross-sectional area of the extruded filament, thus promoting retention of the non-circular shape of the filament.

It has been observed that in melt spinning, the ability of the fiber to retain the shape of the capillary from which it has been extruded is little influenced by the take-up speed of a winder or other post-extrusion carrier. However, just as with circular fibers, the draw-down rate, i.e., take-up speed of the winder, strongly affects the cross-sectional area of the fiber. As the winder take-up speed is increased, the fiber is stretched and the cross-sectional area is decreased.

Each of FIGS. 6–12 illustrates a spinneret capillary having a differently shaped cross-sectional area including at least one lobe-shaped portion. Each of FIGS. 6–12 illustrate a multilobal capillary cross-section and a multilobal cross-section fiber filament. Moreover a comparison of FIGS. *7b* and *7c* illustrates how an identically shaped spinneret capillary cross-sectional area can be used to produce a slightly differently shaped fiber filament by regulating the viscosity of the molten precursor being extruded or the cooling rate of the extruded filament.

In further accordance with the invention, the method for producing a high elastic modulus, high tensile strength carbon fiber, comprises rendering the fiber filament infusible. As embodied herein and shown for example in FIGS. 3 and 4, the filament is rendered infusible by heating the filament in an air atmosphere at about 300° C. for approximately two hours. Thus, the solidified filament is rendered infusible by oxidizing the filament.

In still further accordance with the invention, the method for producing a high elastic modulus, high tensile strength carbon fiber, comprises heating the fiber filament in an inert environment at a temperature sufficient to substantially increase the tensile strength and modulus of elasticity of the fiber filament. This heating step in an inert, i.e., non-oxidizing, environment takes place after the fiber filament has been rendered infusible. As embodied herein and shown for example in FIGS. 3 and 4, the fiber filament was carbonized by raising the filament to a temperature of about 1500° C. in an oxygen-free atmosphere for approximately five minutes. Preferably, the non-oxidizing environment is a nitrogen atmosphere or other inert, i.e., non-oxidizing, environment, such as argon gas.

In the batch melt spinning apparatus indicated in FIG. 3 by the numeral 10, one of the spinnerets 14 shown in FIGS. 5–12 was attached to cartridge 12 and filled with a plurality of chips 16 of a pitch precursor. The cartridge was then heated by means of a heating collar 18 surrounding the cartridge. Back pressure was applied to the pitch precursor by an hydraulic piston 20, which forced a ram down into the cartridge. Once the pitch was melted, this constant pressure hydraulic piston extruded the melt 24 through the capillary 26 of spinneret 14 into a quench cabinet 28. The filaments 30 were taken up on a variable speed winder bobbin 32.

Cartridge 12 was prepared in the following manner. First, anti-seize lubricant was applied to all screws (not shown), the thermocouple (not shown) and the pressure probe connections (not shown). With the cartridge up-side-down, a metal screen (not shown) and an aluminum ring (not shown) were placed in the bottom of the cartridge. One of the spinnerets shown in FIGS. 5–12 was chosen and screwed into the bottom of the cartridge. With the cartridge right-side-up, the thermocouple and pressure probe were screwed into the side of the cartridge. The cartridge was filled with the solid pitch precursor chips to within one inch from the top. A graphite packing ring 34 and ram 22 were placed into the top of the cartridge. The cap was screwed into the top of the cartridge. Then, the complete cartridge was placed into the heating collar, and the thermocouple and pressure probe leads were connected.

During the spinning process, the desired collar temperature set point was set on a temperature controller 36. Collar temperature, melt temperature, melt pressure and hydraulic pressure were monitored. The collar controls set point was readjusted as necessary to maintain the desired spin temperature in the melt as read on a melt temperature read out 38. After the desired spin temperature in the melt was attained, the desired melt pressure was set. Once the desired melt temperature and melt pressure were obtained, a sample was weighed over a known time period, and the mass flow rate was calculated. Using the calculated mass flow rate, the winder speed necessary to achieve the desired drawdown rate (the ratio of spinneret capillary cross-section to a desired cross-section) was determined and recorded. The winder speed controller 40 was set to the position corresponding to the calculated winder speed. Filaments were collected on the winder until an adequate sample had been obtained. The quench air temperature in the quench cabinet was monitored.

The oxidation protocol followed in operation of the embodiment of the invention illustrated in FIGS. 3 and 4 proceeded as follows. A sample of filament was first heated in an oxidation chamber 42 in an air environment at a temperature of 225° C. for a 30 minute period. Then, the temperature was ramped over a 30 minute period from 225° C. to 265° C. Finally, the filament sample was maintained at a temperature of 265° C. for a period of approximately 180 minutes.

In the embodiment of the invention shown in FIGS. 3 and 4, the carbonization protocol proceeded as follows. The oxidized sample of filament was transported through a furnace 44 at a rate of approximately one half foot per minute in an oxygen-free environment of nitrogen gas. During the first two minutes the sample filament was maintained at a temperature of approximately 900° C. Then, during the next two minutes, the sample was maintained at a temperature of approximately 1500° C. In general, during the final two minutes of the carbonization protocol, the sample filament was maintained at the nominal carbonization temperature.

In summary, the embodiment described above of the method of the present invention, proceeds as follows. A petroleum pitch based precursor 24 was prepared by solvent extraction techniques as described in U. S. Pat. No. 4,208,267. The precursor was placed in cartridge 12 and melted at approximately 355° C. Next, hydraulic piston 20 was engaged to apply a substantially constant pressure and extrude precursor 24 at a constant flow rate through capillary 26 of spinneret 14. The precursor solidified as it emerged from capillary 26 into an ambient air atmosphere and was wound up on bobbin 32. Solidification of the precursor was observed to have occurred by the time that filament 30 reached a distance of approximately one inch downstream from the capillary opening. Finally, the fiber filaments were oxidized and carbonized as described above, which were typical commercial conditions for circular carbon fibers.

The multilobal carbon fiber of the present invention has several advantages over the conventional carbon fiber of circular cross-section. One advantage of the multilobal carbon fiber of the present invention is the larger surface area to volume present in the multilobal fiber. This characteristic should improve the wetability of the fiber, and this should yield improved performance in applications where wetability is important. For a given effective diameter, the multilobal fiber can be spun with a larger cross-sectional area than a circular fiber. The effective diameter of a non-circular fiber is defined as the diameter of a hypothetical circular fiber with an equivalent cross-sectional area. Larger fibers should be able to be extruded bulk wise with less fiber breakage because gaseous impurities are more easily released over the larger surface area; and the larger cross section allows the fiber to sustain a greater load during spinning. Production of larger fibers at a given winder take-up speed, permits a greater spinning process throughout. In addition, the multilobal fiber of the present invention is stronger than a circular fiber of comparable effective diameter.

The tensile strength measurements and moduli of elasticity expressed in the examples which follow, typically represent, on average, the results from single filament testing of ten individual filaments taken from the fiber sample. The moduli of elasticity were calculated as the slope of the stress versus strain curve generated during the tensile strength measurement. The photomicrographs shown in FIGS. 13–15 and 18 were obtained using a scanning electron microscope (SEM).

FIG. 13 shows a typical SEM photomicrograph magnification of the conventional circular carbon fibers produced using the apparatus illustrated in FIG. 3. The SEM photo clearly shows that the fiber microstructure is radial in nature. In other words, the crystallites (shown in the photo as light colored streaks) emanate from the center, similar to the spokes of a wheel. This radial structure is typical of carbon fibers spun from mesophase pitch and having a circular transverse cross-sectional area.

The conventional circular carbon fiber transverse cross-section shown in plan view in FIG. 13 has a measured diameter of 14.8 microns, a tensile strength of 244.2 ksi and a modulus of elasticity of 35.13 msi. This fiber was produced with the winder running at a speed of 1469 feet per minute. The capillary of the spinneret used to produce this fiber has a diameter of 0.25 millimeters (mm) and a depth of 1 mm. The melt temperature was 358° C. and the melt pressure was 204 pounds per square inch (psi). This particular sample weighed 1.35 grams (g) and was collected over an eight minute time span.

The SEM's of typical trilobal fibers are shown in FIGS. 14 and 15. Note that the microstructure of these fibers differs from that of the circular fiber shown in FIG. 13. In trilobal fibers, the microstructure does not emanate from a center point, but instead emanates from three centerlines extending from the tip of each lobe. This line-origin microstructure of the trilobal carbon fiber of the present invention contrasts with the point-origin microstructure of a conventional circular carbon fiber in FIG. 13. It is believed that the improved strength of the multilobal fibers of the present invention is caused by this line-origin microstructure.

However, the cause of the improved strength of the trilobal fibers also may be the shorter distance required for oxygen diffusion in a trilobal fiber versus a circular fiber of equivalent cross-sectional area during the oxidation step. Because the trilobal fiber has a greater surface-to-volume ratio, there is more surface available for oxygen to diffuse into the fiber during oxidation. Moreover, because of its trilobal shape, no portion of the trilobal fiber is as thick as the circular fiber of equivalent area. This keeps the oxygen from having to travel as far in the trilobal fiber as the oxygen must travel in the circular fiber to reach the core. In other words, for any given oxidation conditions, such as time and temperature, one would expect the greater surface area and the thinner lobes of the trilobal fiber to allow a greater degree of cross-linking and accordingly cause the fibers to better retain their liquid crystalline orientation through the high temperature carbonization step. Such retention of crystalline orientation is essential for the high strength and stiffness of the carbonized fibers.

Moreover, a comparison of FIGS. 14 and 15 with FIG. 13 is typical of the trilobal and circular fibers and indicates fewer surface flaws in the trilobal fiber. This also would tend to give higher strength to the trilobal fibers. The larger surface-to-volume ratio of a trilobal fiber probably allows a trilobal fiber to more effectively release gas both during fiber formation at extrusion and during the oxidation and carbonization steps than is possible with a circular fiber.

The following examples are presented to illustrate the present invention, but the present invention is not limited to these examples. Each of the examples was prepared according to the above described procedure utilizing a lab scale melt spinning apparatus as illustrated in FIG. 3. The process parameters in the following examples are the same as those described above, unless specifically stated to the contrary in the example.

EXAMPLE 1

The trilobal fiber shown in FIG. 14 was produced using a spinneret having a cross-sectional area shaped as illustrated in FIG. *7a*. This trilobal fiber was oxidized and carbonized under the same conditions as described above. The capillary of the spinneret used to produce this fiber had a width of 0.127 mm, a depth of 0.889 mm, a characteristic length of 0.305 mm and an area of 0.109 $mm^2$. The take-up speed of the winder was 1129 feet per minute during the spinning of this filament, which has a measured diameter of 16.3 microns and an effective diameter of 13 microns. The melt temperature was 353° C., and the melt pressure was 443 psi. This particular sample was not weighed, nor was a time measurement taken over the period during which the sample was collected. The tensile strength was determined to be 240.2 ksi, and the modulus of elasticity was determined to be 32.7 msi.

EXAMPLE 2

The trilobal fiber shown in FIG. 15 was produced using a spinneret having a cross-sectional area shaped as illustrated in FIG. *7a*. This trilobal fiber was oxidized and carbonized under the same conditions as described above. The spinneret used in producing the sample had a lobe width of 0.127 mm, a depth of approximately 0.381 mm, a characteristic length of 0.305 mm and an area of 0.109 $mm^2$. The take-up speed of the winder was 1413 feet per minute during the spinning of this sample, which had a measured diameter of 16.4 microns and a calculated effective diameter of 12.6 microns. The melt temperature was 355° C., and the melt pressure varied between 188 and 200 psi. This particular sample weighed 2.28 grams and was collected over a 15 minute time span. This particular fiber exhibited a tensile strength of 301 ksi and a modulus of elasticity of 40.75 msi.

EXAMPLE 3

Samples of circular and trilobal carbon fibers with approximately equal effective diameters (12+or −2 microns) were carbonized at temperatures ranging from 1500° C. to 2100° C. The carbonizations at temperatures above 1500° C. actually represent a first carbonization at 1500° C. followed by a further carbonization at the higher temperature. The circular fibers were spun at spin temperatures of 353° to 354° C. through a spinneret capillary 0.25 mm in diameter, 1.0 mm in depth and 0.0491 $mm^2$ cross-sectional area. The extrusion rate and winderspeed were slightly altered from the parameters set in producing the fibers shown in FIG. 13, to produce circular fibers with the desired range of diameters. The trilobal fibers were spun at 353° C. through the same spinneret capillary used to produce the fiber shown in FIG. 15 and described in Example 2.

FIG. 16 is a plot of tensile strength versus carbonization temperature. These results show that the trilobal fibers of the present invention consistently have a higher ultimate tensile strength than the conventional circular fibers. While a linear least squares fit of the data shows that the strength of the circular fibers remains relatively constant with carbonization temperature, the trilobal fiber strength increases rapidly and reaches values as high as 395 ksi at 1900° C. The modulus of elasticity of these trilobal fibers is also consistently higher than the circular fibers as shown in FIG. 17, and also reaches a maximum value of 108 msi at 1900° C. Each data point in FIGS. 16 and 17 represents an average of ten single filament tests.

The trilobal spinnerets used to produce the trilobal fibers compared in FIGS. 16 and 17, had a capillary cross-sectional area of 0.109 $mm^2$, and this was about 100 percent larger than the spinneret capillaries used to produce the circular fibers for which data is plotted in FIGS. 16 and 17. Since the same hydraulic system was used to apply pressure to the precursor during the extrusion of the circular fibers as during extrusion during the trilobal fibers, the trilobal fibers tended to be larger in size than the circular fibers. Thus, one would expect the carbonized trilobal fibers to exhibit less strength than the circular fibers. However, to the contrary, a comparison of a least squares fit of the raw data, as shown in FIG. 16, demonstrates that the trilobal fibers have a higher tensile strength. Moreover, the least squares data fit of FIG. 17 shows that the modulus of elasticity of the trilobal fibers increases with increasing carbonization temperature and is consistantly higher than the modulus of circular fibers with equivalent cross-sectional area.

EXAMPLE 4

FIG. 18 shows an SEM of an octalobal fiber made using a spinneret with an octalobal-shaped cross-section capillary as shown in FIG. 12. The octalobal fiber of the present invention shown in FIG. 18 has a measured diameter of 42.8 microns and an effective diameter of 31.3 microns. The tensile strength of this fiber was measured to be 176.2 ksi, and the modulus of elasticity was 28.9 msi. This fiber was produced with a winder running at a speed of 879 feet per minute. The capillary of the spinneret used to produce this fiber has a lobe length of 0.457 mm, a lobe width of 0.0889 mm, a depth of 0.305 mm, and an area of 0.287 $mm^2$. The melt temperature was 355°-357° C., and the melt pressure was 255 to 381 psi. The particular octalobal capillary used to produce the fiber photographed in FIG. 18 had a 485 percent larger cross-sectional area than the cross-sectional area of the circular fiber shown in FIG. 13. Accordingly, the smallest octalobal fibers which could be spun with the melt spinning apparatus of FIG. 3, had an effective diameter of 18.7 microns. The large size of the octalobal-shaped fiber made it difficult to oxidize and carbonize, as indicated by the gas void in the fiber shown in FIG. 18. Nevertheless, the octalobal fiber shown in FIG. 18 exhibits the characteristic line-origin microstructure, which emanates from the centerline of each lobe, and the strength of this fiber is still superior to the strength of a conventional circular carbon fiber with a diameter of 31.3 microns.

It will be apparent to those skilled in the art that various modifications and variations can be made in the carbon fiber and method for producing same without departing from the scope or spirit of the invention. Thus, it is intended that the present invention cover the modifications and variations of this invention, provided these modifications and variations come within the scope of the appended claims and their equivalents.

What is claimed is:

1. A method for producing a high elastic modulus, high tensile strength carbon fiber, comprising:

providing a molten precursor containing a substantial proportion of carbonaceous anisotropic material;

extruding said molten precursor through a spinneret defining a capillary having at least one lobe-shaped cross-sectional area;

solidifying the extruded precursor as it emerges from the spinneret, into a fiber filament having a transverse cross-section which coincides with the transverse cross-section of said capillary;

rendering the fiber filament infusible; and thereafter heating the fiber filament in an inert environment at a temperature sufficient to substantially increase the tensile strength and modulus of elasticity of the fiber filament.

2. The method of claim 1, wherein:

the step of rendering the fiber filament infusible includes heating the fiber filament in an environment including oxygen.

3. The method of claim 1, wherein:

the step of heating the filament is performed in a nitrogen gas environment.

4. The method of claim 1, wherein:

the spinneret defines a capillary having three lobe-shaped cross-sectional areas and the extruded fiber filament emerging from the spinneret is solidified into a fiber having a trilobal cross-section.

5. The method of claim 4, wherein:

the spinneret defines a capillary having a T-shaped cross-sectional area and the extruded precursor emerging from the spinneret is solidified into a fiber filament having a T-shaped cross-section.

6. The method of claim 4, wherein:

the spinneret defines a capillary having a Y-shaped cross-sectional area and the extruded precursor emerging from the spinneret is solidified into a fiber filament having a substantially Y-shaped cross-section.

7. The method of claim 1, wherein:

the spinneret defines a capillary having four lobe-shaped cross-sectional areas and the extruded precursor emerging from the spinneret is solidified into a fiber filament having a quadralobal cross-section.

8. The method of claim 1, wherein:

the spinneret defines a capillary having five lobe-shaped cross-sectional areas and the extruded precursor emerging from the spinneret is solidified into a fiber filament having a pentalobal cross-section.

9. The method of claim 1, wherein:

the spinneret defines a capillary having six lobe-shaped cross-sectional areas and the extruded precursor emerging from the spinneret is solidified into a fiber filament having a hexalobal cross-section.

10. The method of claim 1, wherein:

the spinneret defines a capillary having eight lobe-shaped cross-sectional areas and the extruded precursor emerging from the spinneret is solidified into a fiber filament having an octalobal cross-section.

11. A method for producing a high elastic modulus, high tensile strength carbon fiber, comprising:

providing a molten precursor containing a substantial proportion of carbonaceous anisotropic material;

maintaining the molten precursor at a temperature such that the viscosity of the molten precursor falls within the range between about 250 poise and about 2000 poise;

extruding said molten precursor through a spinneret defining a capillary having at least one lobe-shaped cross-sectional area;

solidifying the extruded precursor as it emerges from the spinneret, into a fiber filament having a transverse cross-section substantially like the transverse cross-section of said capillary;

rendering the fiber filament infusible; and thereafter heating the fiber filament in an inert environment at a temperature sufficient to substantially increase the tensile strength and modulus of elasticity of the fiber filament.

12. A method as in claim 11, wherein:

the step of rendering the fiber filament infusible includes oxidation of the fiber filament.

13. A carbon fiber, said fiber having:

at least one lobe; each said lobe in a transverse cross-section of said fiber having a micro-structure emanating outwardly from a line extending along the length of the lobe.

14. A carbon fiber as in claim 13, wherein the average lobe thickness is no more than about 15 microns.

15. A carbon fiber having a multilobal cross-section, high tensile strength, high modulus of elasticity, and wherein each said lobe in a transverse cross-section of said fiber has a micro-structure emanating outwardly from a line extending along the length of the lobe.

16. A carbon fiber as in claim 15, wherein the circumferential distance between any two adjacent lobes of the fiber is the same.

17. A process for preparing non-uniform cross-sectional carbon filaments comprising:

a) melt spinning a molten pitch having a mesophase content of at least 70% and a viscosity, at a melt spinning temperature, between about 250 and 2000 poise through a spinneret orifice having a non-uniform cross-section, wherein the ratio of the radius of the largest orifice circumscribing circle, R, to that of the smallest, r, is at least 1.4;

b) solidifying and rendering the spun filament infusible, in said non-uniform cross-sectional shape substantially similar to the orifice shape, by oxidatively stabilizing said filament; and c) heating said filament in an inert atmosphere to carbonize it.

18. A high strength multilobal carbon filament wherein the microstructure of a transverse cross-section of each lobe is characterized by a plurality of striations along the length of each lobe and emanating from the center line thereof to the periphery of each lobe.

19. A process for preparing non-uniform cross-sectional carbon filaments of high strength comprising:

a) melt spinning a molten pitch having a mesophase content of at least 70% and a viscosity, at the melt spinning temperature, between about 250 and 2000 poise through a spinneret orifice having a transverse cross-section which includes at least one lobe-shaped portion;

b) solidifying and rendering the spun filament infusible, in a transverse cross-sectional shape substantially similar to the spinneret orifice shape, by oxidatively stablizing said filament; and c) heating said filament in an inert atmosphere to carbonize it.

20. A high strength carbon filament having a transverse cross-section with at least one lobe wherein the microstructure of said transverse cross-section of each lobe is characterized by a plurality of striations along the length of each lobe and emanating from a center line thereof to the periphery of each lobe.

21. A mesophase pitch-based, melt spun carbon or graphite fiber having a transverse cross-sectional area defining a generally triangular shape with substantially rounded vertices.

22. A process for preparing a carbon filament having a transverse cross-sectional area defining a generally triangular shape with substantially rounded vertices, the process comprising:

(a) melt spinning molten pitch having a substantial proportion of mesophase content through a spinneret defining a capillary having a transverse cross-sectional area defining a trilobal shape;

(b) solidifying and rendering the spun filament infusible by oxidatively stabilizing said filament while substantially retaining a triangular shape with substantially rounded vertices; and (c) heating said filament in an inert atmosphere to carbonize it.

23. A pitch-based carbon or graphite fiber filament having been melt spun through a spinneret having a capillary defining at least one lobe, which filament has a tensile strength greater than a carbon or graphite filament of like cross-sectional area that has been melt spun and subsequently processed under substantially similar conditions using a spinneret with a circular cross section capillary.

24. A process for melt spinning a carbon filament, the process comprising:

(a) melt spinning molten pitch having a substantial proportion of mesophase content through a spinneret defining a capillary having a transverse cross-sectional area defining a shape with at least one lobe;

(b) solidifying and rendering the spun filament infusible by oxidatively stabilizing said filament;

(c) heating said filament in an inert atmosphere to carbonize it; and (d) said steps yielding a carbonized filament such that said filament has a tensile strength greater than a circular cross section comparison filament of substantially the same cross-sectional area and that has been melt spun through a circular cross-section spinneret capillary and subsequently processed under substantially similar conditions as said carbonized filament.

* * * * *